United States Patent [19]

Bernardis et al.

[11] Patent Number: 5,054,942

[45] Date of Patent: Oct. 8, 1991

[54] WIRE PRINTING HEAD WITH UNITARY RETURN GROUP

[75] Inventors: Francesco Bernardis, Chiaverano; Elio Fenoglio Gaddo, Prascorsano; Rinaldo Ferrarotti, Ivrea, all of Italy

[73] Assignee: Ing.C. Olivetti & C., S.p.A. Ivrea, Turin, Italy

[21] Appl. No.: 371,280

[22] Filed: Jun. 26, 1989

[30] Foreign Application Priority Data

Jun. 27, 1988 [IT] Italy ..... 67604 A/88

[51] Int. Cl.[5] ..... B41J 2/24

[52] U.S. Cl. ..... 400/124; 101/93.05; 101/93.34

[58] Field of Search ..... 400/124; 101/93.05, 101/93.33, 93.34

[56] References Cited

U.S. PATENT DOCUMENTS

| | | | |
|---|---|---|---|
| 4,218,149 | 8/1980 | Okada | 400/124 |
| 4,423,969 | 1/1984 | Kobryn | 400/124 |
| 4,832,515 | 5/1989 | Kawakami | 101/93.05 |
| 4,881,832 | 11/1989 | Mitsuishi et al. | 400/124 |
| 4,944,615 | 7/1990 | Kato et al. | 101/93.05 |

FOREIGN PATENT DOCUMENTS

| | | | |
|---|---|---|---|
| 124262 | 7/1985 | Japan | 400/124 |
| 22962 | 1/1986 | Japan | 400/124 |
| 148273 | 7/1987 | Japan | 400/124 |

*Primary Examiner*—David A. Wiecking

*Attorney, Agent, or Firm*—Banner, Birch, McKie, & Beckett

[57] ABSTRACT

A needle or wire printing head comprises a plurality of electromagnets with fixed cores, each with two limbs, which are mounted in a ring within a containment body. Movable armatures are disposed in a radiating array in front of coplanar terminal surfaces of said cores. The movable armatures each have a step configuration for oscillating on the terminal surface of the more outward limb, a surface for closing the magnetic flux which, with the terminal surface of the more inward limb constitutes a main air gap "G" and an end capable in printing of engaging a needle by means of a corresponding limb. A unitary return group accomodates a plurality of coil springs in a prestressed state for restoring the movable armatures. There is also provided a magnetically conductive conveying disc of ferro-magnetic material and comprising a plurality of spokes for closure of the magnetic flux which is common to the armatures and the cores.

7 Claims, 5 Drawing Sheets

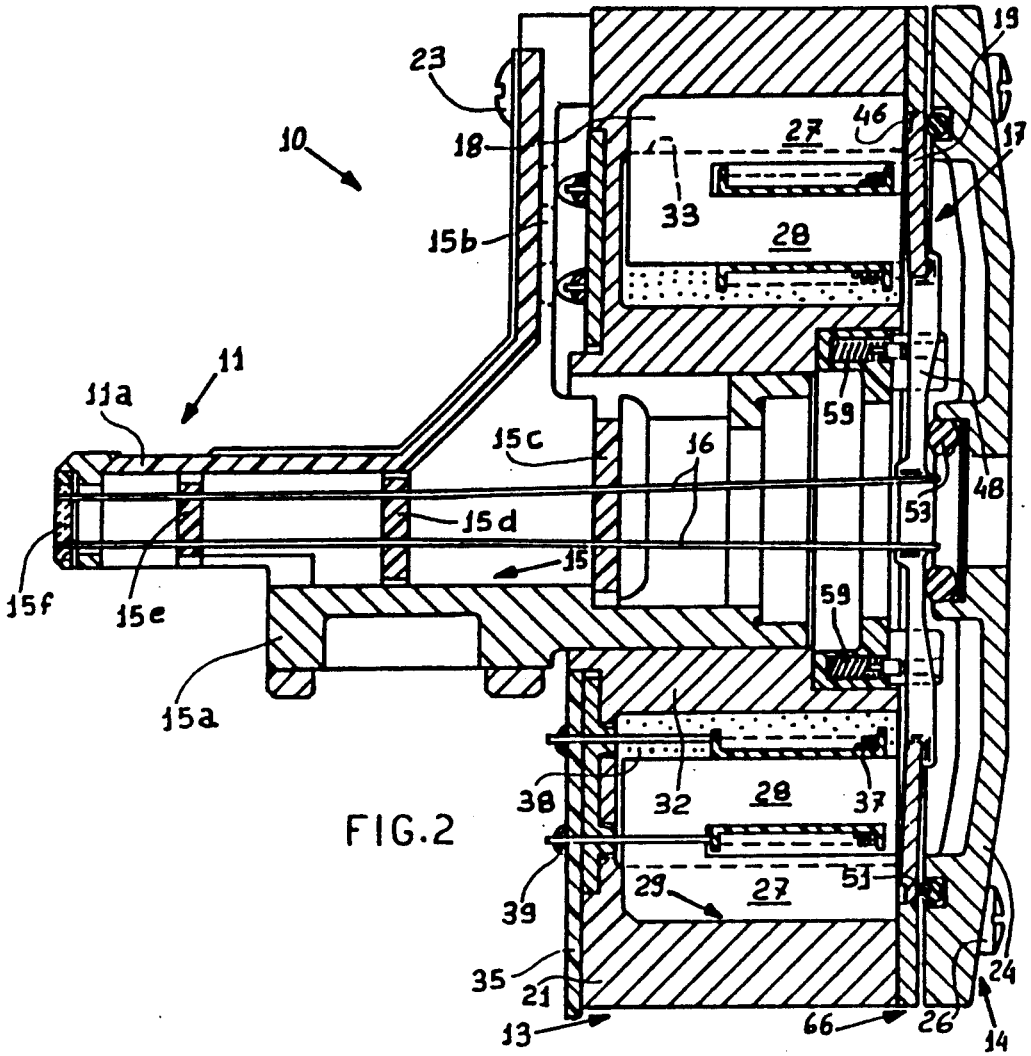
FIG.2
FIG.3
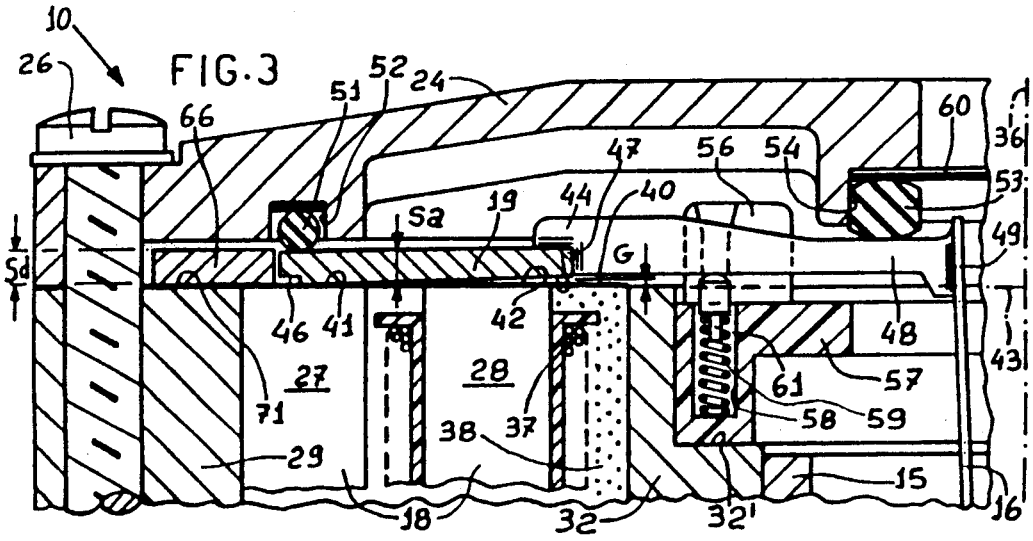

WIRE PRINTING HEAD WITH UNITARY RETURN GROUP

BACKGROUND OF THE INVENTION (1) Field of the Invention

The present invention relates to a wire or needle printing head comprising a plurality of needles and a corresponding plurality of electromagnets or solenoids. Each solenoid has a fixed core and a movable aramature and the fixed core has two terminal surfaces and can be excited to generate a magnetic flux through these surfaces. The movable armature is of a generally elongate shape and has a first oscillating end for selectively actuating in a printing operation a corresponding needle and a magnetic flux-closure surface in juxtaposed relationship with a first one of the two terminal surfaces. The magnetic flux-closure surface together with the first surface of the fixed core form a main air gap of the electromagnet which is variable with the oscillating movement of the first end of the movable armature.

(2) Description of the Prior Art

Printing heads of this type are used generally in present-day needle printers; the main requirement of such heads is that of providing a high speed of printing with moderate powers of excitation of the solenoids. To achieve that aim it is necessary for the movable parts to be light and for the air gap between cores and movable armatures to be very limited. That is in conflict with the need to have a level of printing energy sufficient for printing a plurality of copies and a relatively long travel movement on the part of the needles.

SUMMARY OF THE INVENTION

An object of the present invention is therefore to provide a printing head having a high level of magnetic efficiency for reducing the dimensions of the movable parts and attaining high printing rates.

A further object is to provide sufficiently high levels of printing energy and sufficiently long travel movements on the part of the needles.

A further object of the invention is to provide a printing head which has a very simple design configuration and in which the printing needles are guided and are returned to the rest condition in a highly reliable fashion.

In the printing head of the invention, each solenoid has two associated ferro-magnetic concentration projections delimited by lateral surfaces adjacent to the terminal surfaces of the core of the solenoid. The movable armature is capable of being moved between the lateral sides of these concentration projections. The lateral edges constitute auxiliary air gaps, together with edge surfaces of the movable armature, for closure of part of the magnetic flux through said concentration projections.

According to another aspect of the invention, each needle is joined to a corresponding actuating limb which is in turn fixed to another end of the movable armature. A spring return element acts on the actuating limb in such a manner as to cause it to bear against an annular portion of yielding material. The actuating limbs are guided by a unitary retaining group which accomodates the spring return elements in a prestressed condition, independently of the engagement thereof with said limbs.

BRIEF DESCRIPTION OF THE DRAWINGS

The features of the invention will be apparent from the following description given by way of non-limiting example with reference to the accompanying drawings in which:

FIG. 2 is a view in longitudinal section of the printing head in FIG. 1;

FIG. 3 shows a view on an enlarged scale of some details from FIG. 2;

DESCRIPTION OF THE PREFERRED EMBODIMENTS

Figure 1:
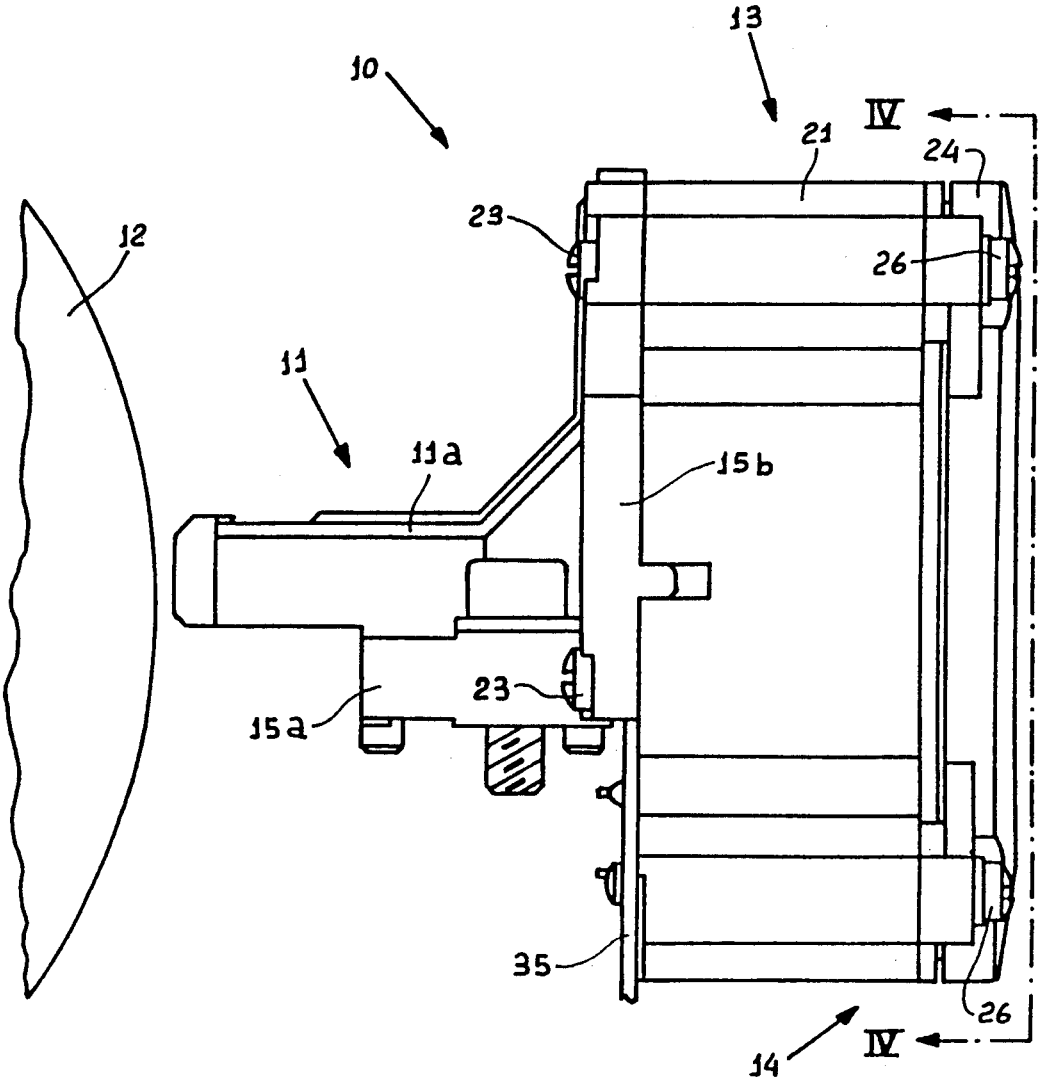
FIG. 1 is side view of the printing head according to the invention.

Referring to FIGS. 1 and 2, the printing head is indicated by reference numeral 10 and comprises a front portion (nose) 11 which is intended to be directed towards a platen roller 12, an intermediate portion 13 and a rear portion 14.

The front portion or nose 11 comprises a tubular housing 15 provided with a lower flange **15*a* and rear flanges 15*b*. The lower flange 15*a* is provided for fixing the head 10 to a carriage (not shown) which is arranged to be moved transversely in front of the roller 12 and the rear flanges 15*b* connect the nose 11 to the intermediate portion 13**.

Fixed within nose 11 are a plurality of transverse walls **15*c*, 15*d* and 15*e* comprising guide holes which support a plurality of printing needles or wires 16. The needles 16 are finally guided adjacent to the roller 12 by a guide matrix 15*f* of hard material which is fixed to the front portion of the nose 11 in a manner known in the art. Finally the nose 11 comprises an upper opening which is closed by a cover 11*a* fitted between the front portions of the nose and the rear flanges 15*b*** thereof.

The intermediate portion 13 of the head 10 includes within same a plurality of electromagnets or solenoids 17 comprising fixed cores 18 and movable armatures 19 operable to actuate the needles 16 for the printing operation. The cores 18 are mounted within a containment body 21 and the needles 16 can be displaced longitudinally by the movable armatures 19 for the printing operation. The nose 11 is fixed at the rear to the containment body 21 by means of screws 23.

The rear portion 14 of the head 10 comprises a cover 24, which is fixed to the body 21 by means of screws 26, which provides for urging a part of the armatures 19 towards the cores 18, as will be described hereinafter.

Figure 4:
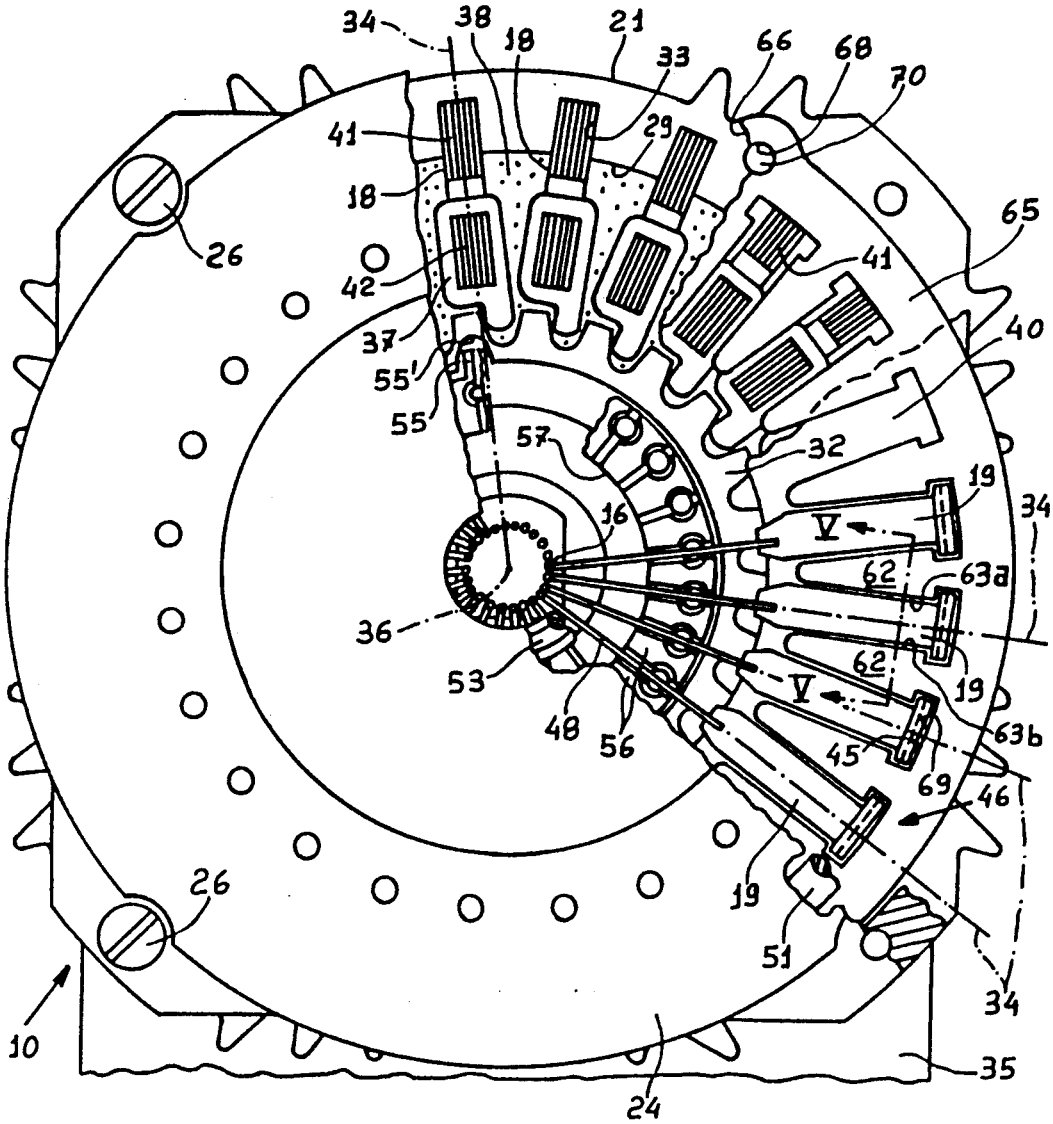
FIG. 4 is a rear partial sectional view of the printing head taken along line IV—IV in FIG. 1.
Figure 6:
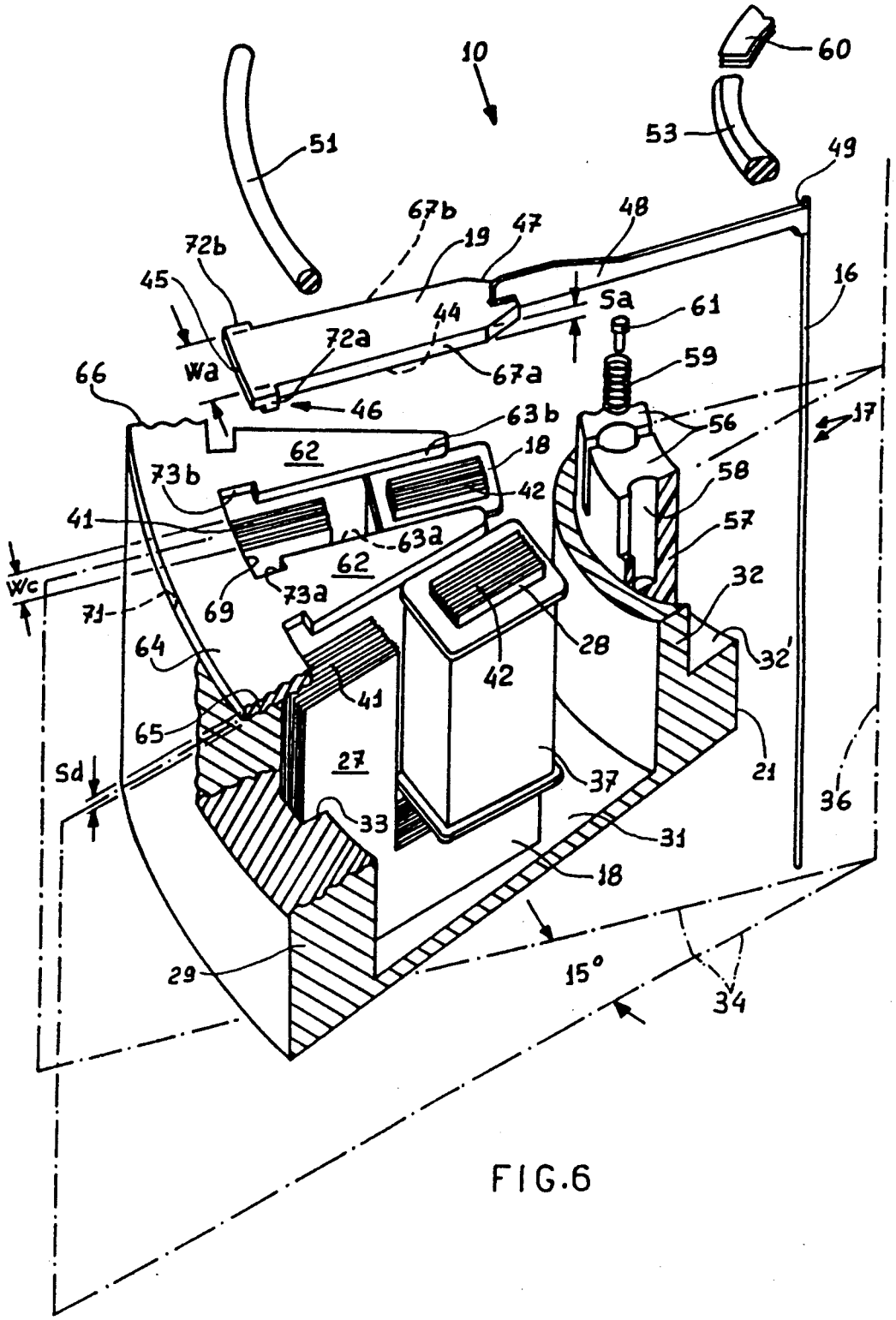
FIG. 6 is a sectional perspective view of part of the head shown in FIG. 1.

The cores 18 are formed by a pack of ferro-cobalt plates with two limbs 27 and 28 to define a generally U-shaped configuration. The containment body 21 is of a cup-shaped form and is defined by a tubular outside wall 29 and a front wall 31 and contains within same a tubular projection 32. The cores 18 (see FIGS. 4 and 6)

are fixed by their limbs 27 to inward recesses 33 in the tubular wall 29 and form a ring within the wall 29.

The limbs 27 are located in the peripheral portion of the head 10 and the limbs 28 are disposed adjacent to the projection 32. The cores 18 also define central planes 31 which pass through a longitudinal axis 36 of the head 10 and which are angularly spaced at a constant pitch. In the embodiment described herein the head comprises twenty four needles 16 and the planes 34 of the cores 18 are then spaced at 15°.

Fixed on the inward arm 28 of each of the cores 18 are corresponding excitation coils 37. The assembly, formed by the cores 18 and the coils 37 is encased in a potting mass of resin 38 (see FIG. 2) which fills the space between the inward walls of the body 21 and the cores 18 with the respective coils 37 in the manner described in the U.S. patent application Ser. No. 289,840 filed on Dec. 27, 1988, now U.S. Pat. No. 4,995,743 issued Feb. 26, 1991 assigned to the same assignee of the present application and incorporated herein by reference thereto.

In particular the leads of the coils 37, which are indicated at 39, pass through corresponding openings in the front wall 31 and are soldered to terminals of a closure plate 35 of plastics material, in a similar manner to the arrangement described in above-referenced U.S. Pat. No. 4,995,743.

The limbs 27 and 28 of the cores 18 (FIGS. 3 and 4) are delimited by terminal surfaces 41 and 42 respectively which, after the cores are assembled to the body 21, are disposed in the same plane 43 which is perpendicular to the longitudinal axis 36. Interposed between the terminal surfaces 41 and 42 and the respective movable armatures 19 is a thin separating disc 40 of kapton, which performs an anti-adhesion function.

The movable armatures 19 are formed by plates of ferro-magnetic material such as a ferro-cobalt alloy and each has a magnetic flux-closure surface 44 which faces towards the terminal surfaces 41 and 42 of the cores 18. The armatures 19 (see FIG. 6) are of an elongate rectangular shape and have one end 45 with a step configuration 46. An opposite end 47 of each armature 19 is tapered and fixed by means of welding to a limb 48 formed by a thin steel plate perpendicular to the surface 44.

Fixed by welding to one end 49 of the limb 48 is an end of a corresponding needle 16. The limb 48 is very light and is of such a shape as to be of a decreasing section from the region at which it is welded to the end 47, to the region in which it is welded to the needle 16.

When the head 10 is in the assembled condition the movable armatures 19 (see FIG. 4) are in a star-like configuration and each movable armature is disposed symmetrically with respect to the central plane 34 of the associated core 18. A ring 51 of resilient material, for example silicone rubber is accomodated in a recess 52 (see also FIG. 3) in the cover 24 and acts on the armatures 19 in such a way as to cause the respective step configurations 46 to bear against the terminal surfaces 41 of the cores 18. A second ring 53 which is also of resilient material is accomodated in a recess 54 in the cover 24 in the vicinity of the ends 49 of the limb 48.

An intermediate portion of each of the limbs 48 is guided, on the same axis as the respective planes 34, by corresponding ribs 56 of a guide body 57. The guide body is of an annular shape, is made of low-friction plastics material and is engaged in a seat 32'. In the tubular projection 32 on the containment body 21. The angular position thereof is unambiguously defined with respect to the cores 18 by a key 55 engaged in a recess 55' in the tubular projection.

Between the ribs 56 the guide body 57 has cylindrical spaces 58 in which return springs 59 are disposed. By means of plungers 61 the springs 58 urge the respective limbs 48 towards the cover 24 until they come to bear against the ring 53. The surface 44 of the armature 19 and the terminal surface 42 of the limb 28 define the main air gap "G" of the solenoid 17. The rest position of the needles 16 and the air gap "G" depend on the thickness of the ring 43 and are precisely adjusted by a series of discs 60 of mylar which are disposed in the bottom of the recess 54 and the number of which defines the operating travel of the needles.

In accordance with the invention, for each movable armature 19, the head 10 comprises a pair of projections 62 of ferro-magnetic material, for example pure iron, which are delimited by lateral surfaces **63*a* and 63*b* (see FIG. 6) which are parallel to the central plane 34 of the respective core 18 and which are spaced from the surfaces 41 and 42. The projections 62 are interconnected by intermediate portions 64 and are produced, for example by cutting a plate, in the form of spokes of substantially triangular shape of a magnetically conducting conveying disc 66 which is common to all the solenoids 17. The disc 66 comprises in particular an outer peripheral annular portion 65 in which the projections 62 are directed towards the longitudinal axis 36, when the head 10** is in the assembled condition.

The movable armatures 19 with their lateral surfaces as indicated at **67*a* and 67*b* are capable of moving between the lateral surfaces 63*a* and 63*b* of the projections or spokes 62. The surfaces 63*a* and 63*b* and the surfaces 67*a* and 67*b* represent the auxiliary air gaps "Ga" and "Gb" (see FIG. 5) with respect to the main air gap "G". To ensure parallelism of the surfaces 63*a* and 63*b* (see FIGS. 4 and 6) with the planes 34, the annular portion 65 is provided with holes 68 which are precisely connected to pins 70 which are fixed on the body 21**.

The conveying disc 66 is of thickness "Sd" which is comparable to the thickness "Sa" of the movable armatures 19. When the head 10 is in the assembled condition, the ring 51, besides acting on the armatures 19, also provides for urging the disc 66 against an edge 71 of the wall 29 of the body 21 and the peripheral annular portion 65 is disposed in front of a part (about 30%) of the terminal surface 41 of the outward limbs 27 of the cores 18.

The outward ends 45 of the movable armatures 19 are in turn accomodated in corresponding seats 69 in the peripheral annular portion 65 of the disc 66. In addition the end 45 of each armature 19, adjacent to the step configuration 46, comprises two lateral projections **72*a* and 72*b* which are engaged in two corresponding lateral openings 73*a* and 73*b* in the seats 69. That makes it possible to retain the movable armatures 19 and thus the needles 16 in a fixed radial position which is clearly defined with respect to the axis 36**.

In response to excitation of a coil 37 (see FIG. 2) the corresponding movable armature 19 oscillates at its step configuration (see FIGS. 4 and 5) and reduces the air gap "G", urging the needle 16 in the printing direction. The magnetic flux generated by the coil 37 and which is operable to move the armature 19, besides being completed through the air gap "G", is also completed throgh the air gaps "Ga" and "Gb".

The armatures 19 according to the invention are of a width "Wa" which is comparable to the width "Wc" of the surfaces 41 and 42 of the cores 18. The air gaps "Ga" and "Gb" reduce the reluctance of the magnetic circuit formed by the core 18 and the armature 19 and improve the level of magnetic efficiency. With the materials used, the energy transferred to the needles 16 and the travel movement of the needles being the same, the weight of the armatures 19 can therefore be reduced in comparison with the know arrangement of the state of the art, permitting an increase in the frequency of activation of the needles.

Preferably the thickness "Sd and Sa" are respectively 1.5 mm and 1.6 mm. The separation disc 40 is of a thickness of 0.03 mm and the air gap "G" is 0.15 to 0.20 mm. The limbs 48 are of a thickness of 0.30 mm and the needles are 0.25 mm in diameter.

Figure 5:
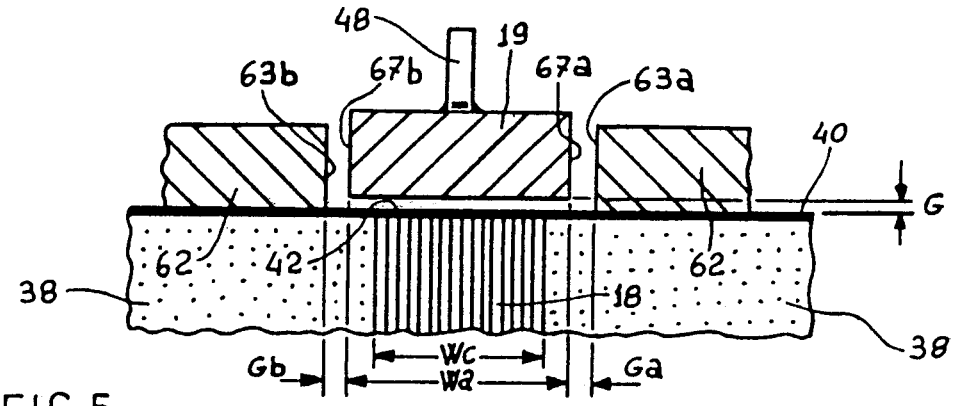
FIG. 5 shows details from FIG. 4 in section taken along line VV.

In the embodiment shown in FIG. 5 the armatures are wider than the surfaces 41 by about 40% in such a way that the distance between the surfaces 63*a* and 63*b* and the surfaces 41 and 42 is much greater than the air gaps "G", "Ga" and "Gb". The widths "Wc" and "Wa" are respectively 2.1 mm and 3 mm and the distance between the surfaces 63*a* and 63*b* of the spokes 62 is 3.3 mm, when the air gaps "Ga" and "Gb" are 0.15 mm.

Figure 9:
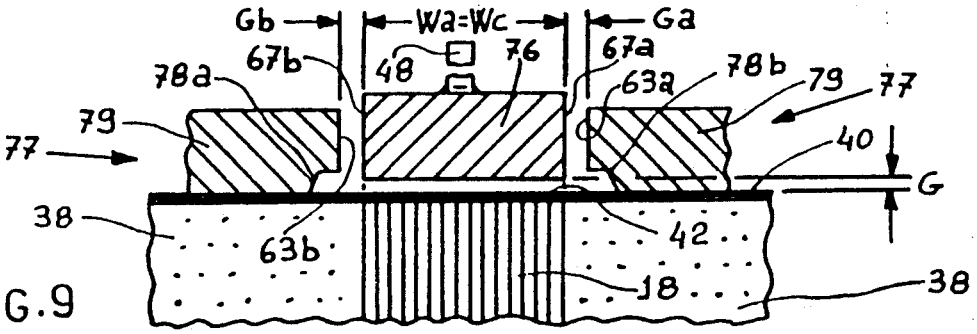
FIG. 9 is an alternative form of the details from FIG. 5.

FIG. 9 shows a highly efficient alternative construction in which "Wa" is 2.1 mm, equal to "Wc". The movable armatures and the associated spokes are as indicated at 76 and 77. The distance between the corners, comprise recesses 78*a* and 78*b* which are 0.3 mm in depth and 0.3 mm in width and additional 45° bevels. When the head 10 is in the assembled condition the recesses 78*a* and 78*b* are disposed facing the lateral corners of the cores 18, corresponding to the surfaces 41 and 42, and prevent a component part of the magnetic flux at the core 18 being closed as between the limbs 27 and 28 without involving the movable armature 76.

With the embodiment described herein it is possible to achieve rates of oscillation of the needles of 2500 Hz for a working travel of 0.25–0.40 mm, such as to permit printing of at least two carbon copies.

Figure 7:
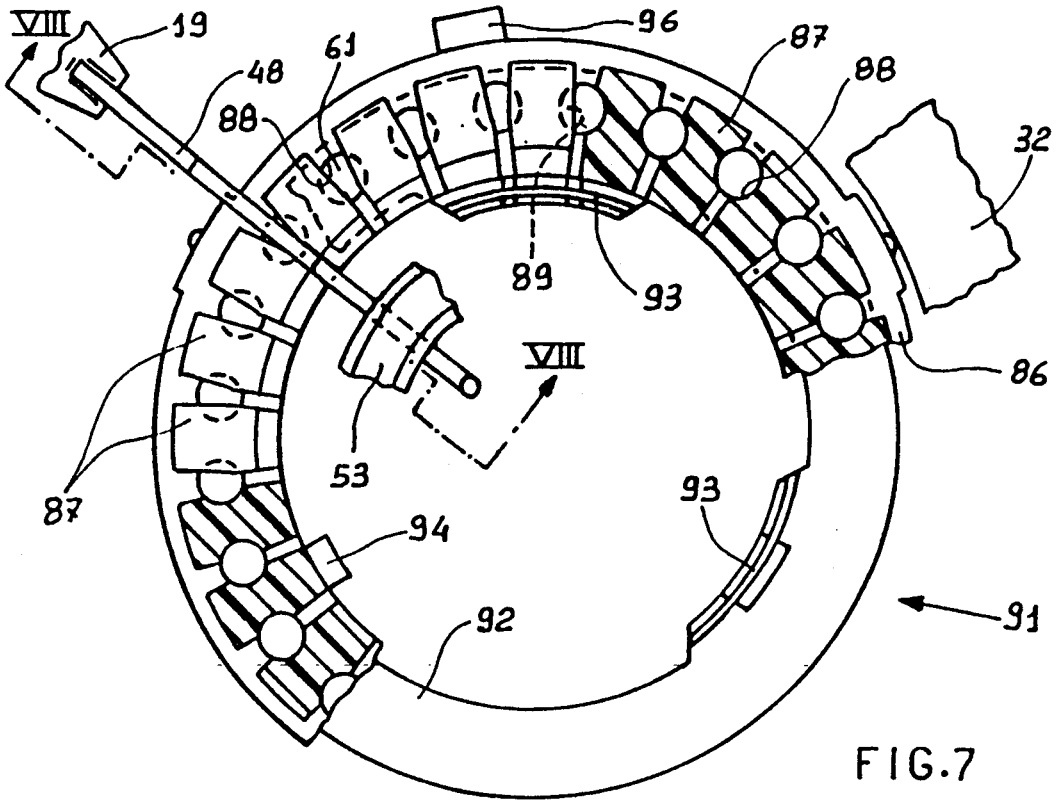
FIG. 7 is a partly sectional view of an alternative form of some details of FIG. 4.
Figure 8:
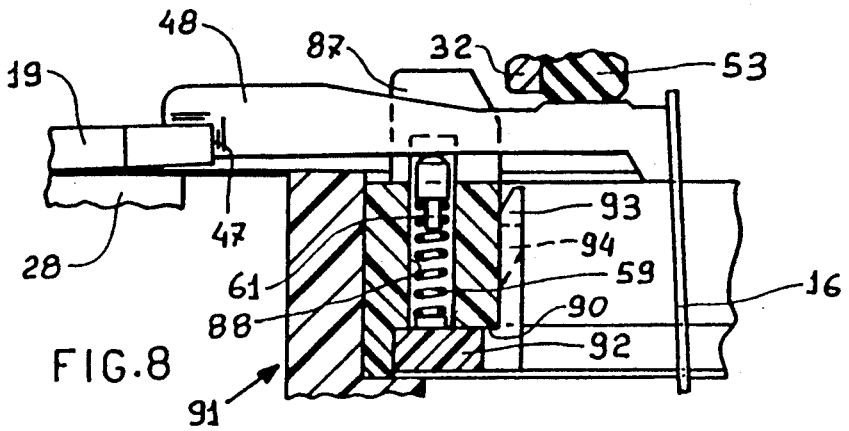
FIG. 8 is a view in section taken along line VIII—VIII in FIG. 7.

FIGS. 7 and 8 show an alternative embodiment of the guide body for the limbs 48, indicated herein at 86, comprising ribs 87 and recesses 88 with the same function as the ribs 56 and the recesses 58 in FIG. 3.

Each rib 87 has a shoulder 89 which partially closes off the subjacent recess 88 but permits guidance of the limb 48. The shoulders 89 retain the plungers 61 in the recesses 88 in the absence of any counteracting action on the part of the limbs 48 while however permitting upward movement of the limbs 48 until the limbs come to bear against the ring 53.

The springs 59 and the plungers 61 are assembled to the guide body 86 in a preliminary operation to form a unitary return group as indicated at 91. In particular the springs 59 and the plungers 61 are fitted into the recesses 88 through the lower part 90 of the guide body 86. The recesses 88 are then closed at their bottom by a retaining ring 92 which can be locked to the part 90 by means of resilient clips 93 engaged with corresponding teeth 94 on the guide body 86.

The springs 59 are compressed and are retained in position by the ring 92 in such a way as to urge the plungers 61 against the shoulders 89 of the ribs 87. The guide body 86 is provided with a key 96 and the entire return group 91 is fixed. In the seat 32' of the tubular projection 32, the key 96 thereof engaging into the recess 55', thereby to dispose the ribs 87 symmetrically at the sides of the central planes 43 of the cores 18.

It will be apparent that other modifications and improvements may be made in the above described head without departing from the scope of the invention.

We claim:

1. In a needle printing head comprising a plurality of needles and a corresponding plurality of electromagnets, wherein each electromagnet comprises a fixed core with two terminal surfaces which can be excited to generate a magnetic flux through said surfaces and a movable armature of generally elongated shape, wherein each said movable armature has a portion which is normally held in a position of maximum distance of said air gap by the action of a corresponding spring return element, the improvement wherein;

each needle is actuatable by a corresponding actuating elongated member which is fixed to an end of the corresponding said movable armature;

each spring return element acts on a portion of the actuating elongated member in such a way to make said elongated member bear against a stop element of yielding material, and each said spring return element is accommodated in a unitary return group in a prestressed state, independently of engagement with said needles;

wherein said spring return elements comprise coil springs individually associated with said elongated members and the unitary return group comprising a guide body and retaining means;

wherein said guide body is provided with recesses for accommodating said coil springs in alignment with said portions of the elongated members, cooperating surfaces for retaining said coil springs in said recesses and openings for permitting the passage and the movement of said portions of the elongated members, and wherein said retaining means is coupled with the guide body and acts against said coil springs to compress the coil springs against said cooperating surfaces in said prestressed status.

2. A printing head according to claim 1, wherein said elongated member comprises a limb and each of said openings comprises guide surfaces for guiding said limbs.

3. A printing head according to claim 1, wherein said retaining means comprises a retaining ring and resilient members for locking said retaining ring to said guide body.

4. A printing head according to claim 1, further comprising a magnetically conducting disc of ferro-magnetic material which is coupled to said fixed cores and which is provided with spokes adjacent to said terminal surfaces, said spokes defining with said movable armatures auxiliary air gaps for reducing the magnetic reluctance of the assembly formed by the fixed cores and the movable armatures.

5. A printing head according to claim 4, wherein said guide body comprises guide surfaces for guiding said elongated members, wherein each movable armature comprises an end fulcrumed on one of said two terminal surfaces, wherein said end includes two lateral projections and wherein said conducting disc includes lateral openings for retaining the movable armatures in fixed radial positions with respect to said fixed cores and said spokes.

6. In a needle printing head comprising a plurality of needles and a corresponding plurality of electromagnets, wherein each electromagnet comprises a fixed core with two terminal surfaces which can be excited to generate a magnetic flux through said surfaces and a movable armature of generally elongated shape, wherein each said movable armature has one end fulcrumed on one of said two terminal surfaces, and wherein each movable armature is normally held in a position of maximum distance of an air gap by the action of a corresponding spring return element, the improvement wherein:

each needle is welded to a corresponding actuating limb which is also fixed to another end of the corresponding said movable armature;

each return element acts on said limb in such a way to make said limb bear against a stop ring of yielding material, and said actuating limbs are guided by a unitary return group which accommodates the spring return elements, in a prestressed state, independently of engagement with said limbs;

wherein said spring return elements comprise coil springs individually associated with said limbs and the unitary return group comprises a guide body and a retaining ring, wherein the guide body is provided with ribs for guiding said limbs, recesses for accommodating said coil springs in alignment with said limbs and cooperating surfaces on the ribs for retaining said coil springs in said recesses and permitting the movement of said limbs, and wherein said retaining ring is coupled with the guide body to close said recesses and act against said coil springs in opposite relationship with respect to said ribs.

7. A head according to claim 6, characterized by a magnetically conducting disc of ferro-magnetic material which is coupled to the fixed cores of said electromagnets and which is provided with spokes adjacent to said terminal surfaces, said spokes defining with the movable armature auxiliary air gaps for reducing the magnetic reluctance of the assembly formed by said fixed cores and said movable armatures.

* * * * *